US009829823B2

(12) United States Patent
Morishita et al.

(10) Patent No.: US 9,829,823 B2
(45) Date of Patent: Nov. 28, 2017

(54) CHARGING DEVICE HAVING MOVABLE CHARGING MEMBER AND MOVABLE CLEANING MEMBER AND IMAGE FORMING APPARATUS INCLUDING THE CHARGING DEVICE

(71) Applicant: KYOCERA Document Solutions Inc., Osaka (JP)

(72) Inventors: Hiroki Morishita, Osaka (JP); Nobuhiro Nishioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/292,160

(22) Filed: Oct. 13, 2016

(65) Prior Publication Data

US 2017/0139341 A1 May 18, 2017

(30) Foreign Application Priority Data

Nov. 12, 2015 (JP) ..... 2015-222228

(51) Int. Cl.
*G03G 15/02* (2006.01)

(52) U.S. Cl.
CPC ..... *G03G 15/0258* (2013.01)

(58) Field of Classification Search
CPC ..... G03G 15/0216; G03G 15/0225; G03G 15/0258
See application file for complete search history.

(56) References Cited

U.S. PATENT DOCUMENTS 5,697,020 A * 12/1997 Sato ..... G03G 15/0225 361/225
7,460,810 B2 * 12/2008 Sampe ..... G03G 15/0225 399/100
2011/0069989 A1 * 3/2011 Kim ..... G03G 21/1821 399/115
2012/0177407 A1 * 7/2012 Lee ..... G03G 21/1814 399/168
2015/0043940 A1 * 2/2015 Tsuji ..... G03G 15/0225 399/100
2016/0216688 A1 * 7/2016 Katayama ..... G03G 21/1821

FOREIGN PATENT DOCUMENTS

JP 2005-134760 A 5/2005
JP 2012242567 A * 12/2012

* cited by examiner

*Primary Examiner* — Benjamin Schmitt
*Assistant Examiner* — Milton Gonzalez
(74) *Attorney, Agent, or Firm* — Studebaker & Brackett PC

(57) ABSTRACT

A charging device includes a charging member, a cleaning member, and a bearing. The charging member charges an image carrier. The cleaning member cleans the charging member. The bearing includes a first bearing part and a second bearing part. The first bearing part rotatably supports the charging member. The second bearing part rotatably supports the cleaning member and is divided from the first bearing part. The first bearing part is movable between a first contact position to make the charging member come into contact with the image carrier and a first separating position to make the charging member separate from the image carrier. The second bearing part is movable between a second contact position to make the cleaning member come into contact with the charging member and a second separating position to make the cleaning member separate from the charging member.

6 Claims, 12 Drawing Sheets

CHARGING DEVICE HAVING MOVABLE CHARGING MEMBER AND MOVABLE CLEANING MEMBER AND IMAGE FORMING APPARATUS INCLUDING THE CHARGING DEVICE

INCORPORATION BY REFERENCE

This application is based on and claims the benefit of priority from Japanese patent application No. 2015-222228 filed on Nov. 12, 2015, which is incorporated by reference in its entirety.

BACKGROUND

The present disclosure relates to a charging device configured to charge an image carrier and an image forming apparatus including the charging device.

Conventionally, an image forming apparatus, such as a printer, a copying machine, a facsimile, and a multi-function peripheral (MFP), includes a charging device configured to charge an image carrier, such as a photosensitive drum. For example, a known charging device includes a charging member configured to charge an image carrier and a cleaning member configured to clean the charging member.

SUMMARY

In accordance with an embodiment of the present disclosure, a charging device includes a charging member, a cleaning member, and a bearing. The charging member is configured to charge an image carrier. The cleaning member is configured to clean the charging member. The bearing is configured to rotatably support the charging member and the cleaning member. The bearing includes a first bearing part and a second bearing part. The first bearing part is configured to rotatably support the charging member. The second bearing part is configured to rotatably support the cleaning member and divided from the first bearing part. The first bearing part is movable between a first contact position to make the charging member come into contact with the image carrier and a first separating position to make the charging member separate from the image carrier. The second bearing part is movable between a second contact position to make the cleaning member come into contact with the charging member and a second separating position to make the cleaning member separate from the charging member.

In accordance with an embodiment of the present disclosure, an image forming apparatus includes the charging device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an MFP 1 (image forming apparatus) according to an embodiment of the present disclosure will be described with reference to the drawings. Arrows Fr, Rr, L, R, U and Lo optionally added to each drawing indicate a front side, a rear side, a left side, a right side, an upper side and a lower side of the MFP 1, respectively.

First, an outline of the configuration of the MFP 1 will be described.

Figure 1:
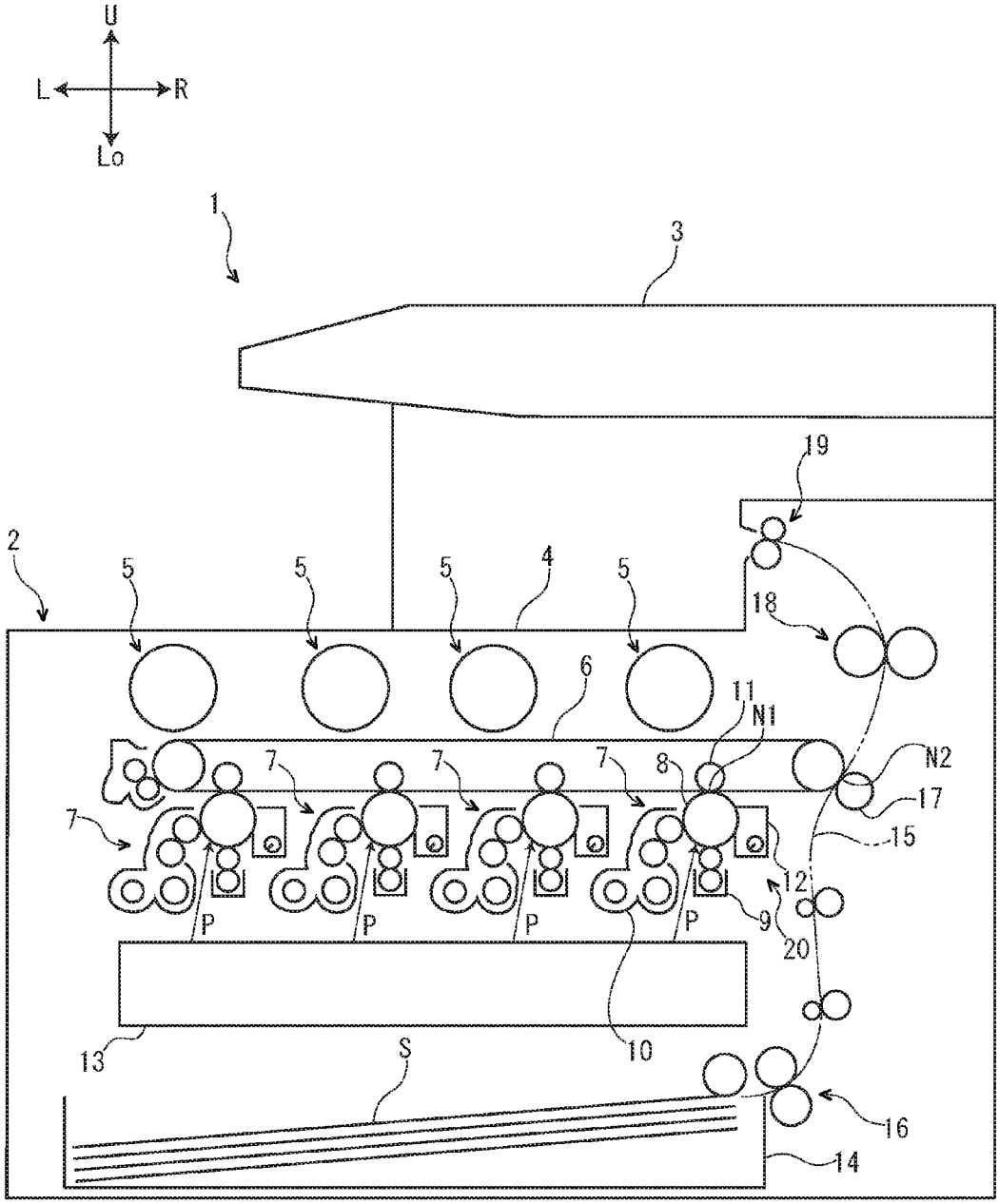
FIG. 1 is a schematic view showing an outline of a multi-function peripheral (MFP) according to an embodiment of the present disclosure.

As shown in FIG. 1, the MFP 1 includes a box-formed MFP main body 2 (an apparatus main body). In an upper end part of the MFP main body 2, an image reading device 3 to read an original image is arranged. In an upper part of the MFP main body 2, a sheet ejecting tray 4 is arranged below the image reading device 3. In the upper part of the MFP main body 2, four toner containers 5 are arranged below the sheet ejecting tray 4. The four toner containers 5 correspond to toners of yellow, magenta, cyan, and black in an order from the left side to the right side.

In a roughly middle part of the MFP main body 2, an intermediate transfer belt 6 is housed below the four toner containers 5. In the roughly middle part of the MFP main body 2, four image forming parts 7 are housed below the intermediate transfer belt 6. The four image forming parts 7 correspond to toners of yellow, magenta, cyan, and black in the order from the left side to the right side. Each image forming part 7 includes a photosensitive drum 8 (an image carrier), a charging device 9, a developing device 10, a primary transfer roller 11, and a cleaning device 12. The primary transfer roller 11 sandwiches the intermediate transfer belt 6 with the photosensitive drum 8 so as to form a primary transfer nip N1 between the intermediate transfer belt 6 and the photosensitive drum 8. The photosensitive drum 8, the charging device 9, and the cleaning device 12 are integrated as a drum unit 20, which is described in detail later.

In a lower part of the MFP main body 2, an exposure device 13 is housed below the four image forming parts 7. In a lower end part of the MFP main body 2, a sheet feeding tray 14 is housed below the exposure device 13. In the sheet feeding tray 14, a sheet S (a recording medium) is accommodated.

At a right sidepart of the MFP main body 2, a conveying path 15 for the sheet S is arranged. At a lower end part (an upstream end part) of the conveying path 15, a sheet feeding part 16 is arranged. At an intermediate stream part of the conveying path 15, a secondary transfer roller 17 is arranged. Between the secondary transfer roller 17 and the intermediate transfer belt 6, a secondary transfer nip N2 is formed. At an upper part (a downstream part) of the conveying path 15, a fixing device 18 is arranged. At an upper end part (a downstream end part) of the conveying path 15, a sheet ejecting part 19 is arranged.

Next, an operation of the MFP 1 with such a configuration will be described.

When an instruction to start printing is given to the MFP 1, firstly, the charging device 9 electrically charges a surface of the photosensitive drum 8. Then, an electrostatic latent image is formed on the surface of the photosensitive drum 8 by a laser light (refer to an arrow P in FIG. 1) from the exposure device 13. Then, the developing device 10 supply a toner to the photosensitive drum 8, so that the electrostatic latent image formed on the surface of the photosensitive drum 8 is developed and a toner image is carried by the photosensitive drum 8. This toner image is primarily transferred to a surface of the intermediate transfer belt 6 at the primary transfer nip N1. Such an operation is carried out at each image forming part 7 to form a full color toner image on the intermediate transfer belt 6. Incidentally, a toner remained on the photosensitive drum 8 is removed by the cleaning device 12.

On the other hand, the sheet S picked from the sheet feeding tray 14 by the sheet feeding part 16 is conveyed to a downstream side of the conveying path 15 and enters the secondary transfer nip N2. At the secondary transfer nip N2, the full color toner image formed on the intermediate transfer belt 6 is secondarily transferred to the sheet S. The sheet S to which the toner image is secondarily transferred is further conveyed to the downstream side of the conveying path 15 and enters the fixing device 18. At the fixing device 18, the toner image is fixed on the sheet S. The sheet S on which the toner image is fixed is ejected on the sheet ejecting tray 4 by the sheet ejecting part 19.

Next, the drum unit 20 will be described in detail.

Figure 2:
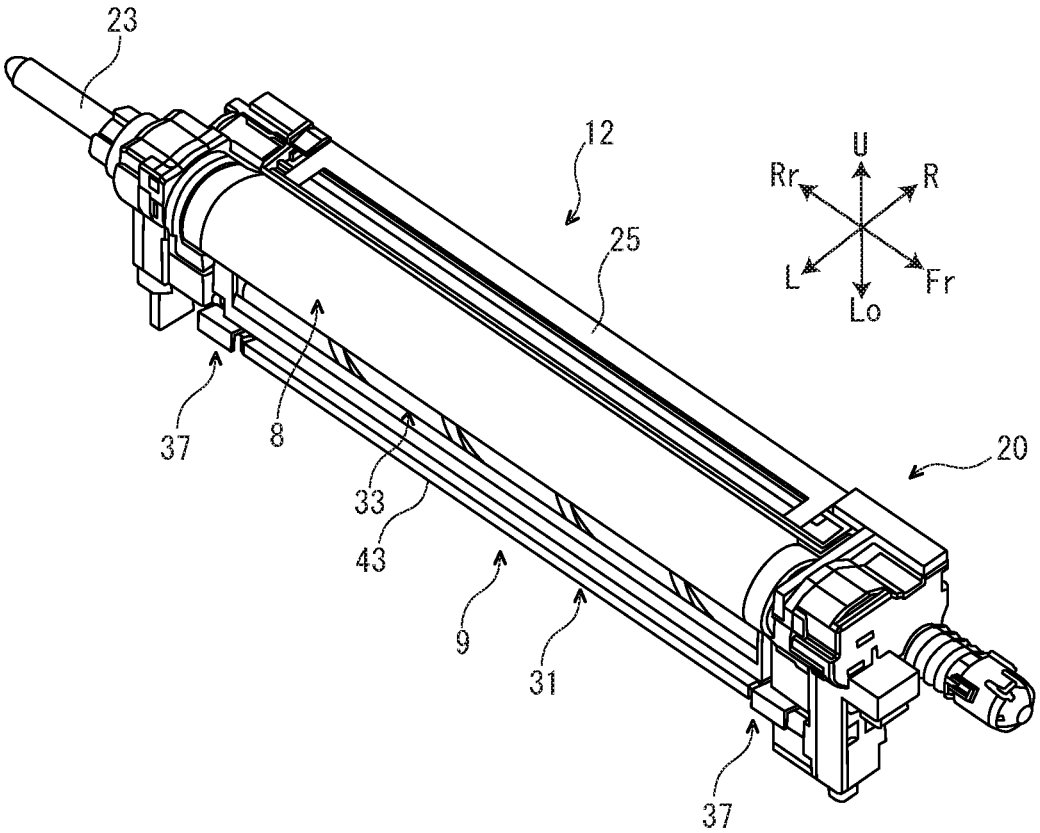
FIG. 2 is a perspective view showing a drum unit according to the embodiment of the present disclosure.

As shown in FIG. 2 and other figures, the drum unit 20 is formed in a shape elongated in a front and rear direction. The drum unit 20 is configured to be pushed toward the rear side and be attached to the MFP main body 2 along the front and rear direction. That is, in the present embodiment, an attachment direction of the drum unit 20 to the MFP main body 2 is the front and rear direction (a direction from the front side to a rear side).

The drum unit 20 includes the photosensitive drum 8, the cleaning device 12 arranged at a right side of the photosensitive drum 8, and a charging device 9 arranged at a lower side of the photosensitive drum 8. Hereinafter, these components will be described in order.

First, the photosensitive drum 8 of the drum unit 20 will be described.

The photosensitive drum 8 is formed in a cylindrical shape elongated in the front and rear direction. The photosensitive drum 8 is composed of an amorphous silicon or an organic photosensitive body, for example. The photosensitive drum 8 is rotatable around a drum shaft 23. The photosensitive drum 8 is connected with a driving source (not shown) composed of a motor or the like.

Next, the cleaning device 12 of the drum unit 20 will be described.

Figure 3:
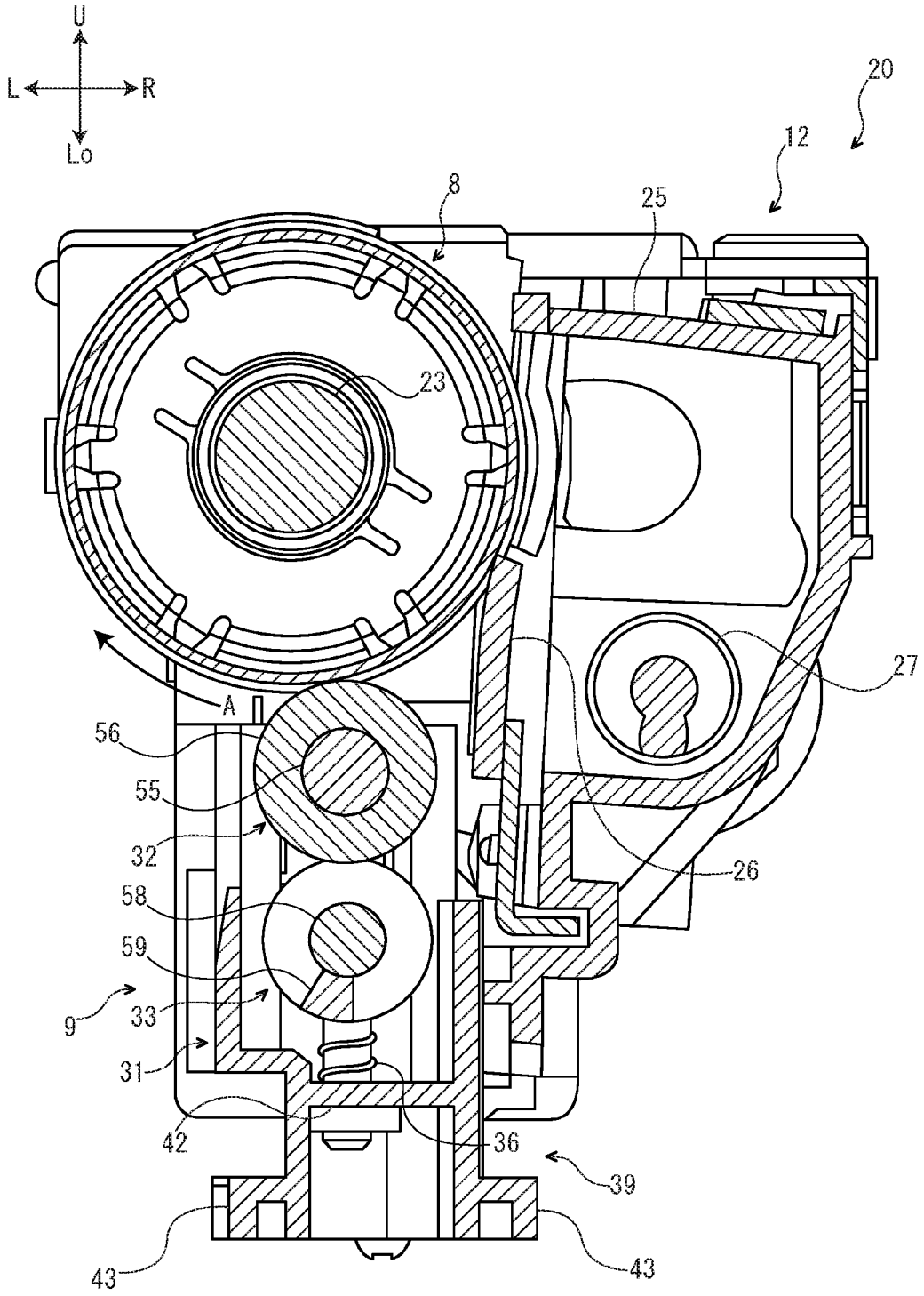
FIG. 3 is a sectional view showing a state that a charging roller comes into contact with a photosensitive drum and a cleaning roller comes into contact with the charging roller, in the drum unit according to the embodiment of the present disclosure.
Figure 4:
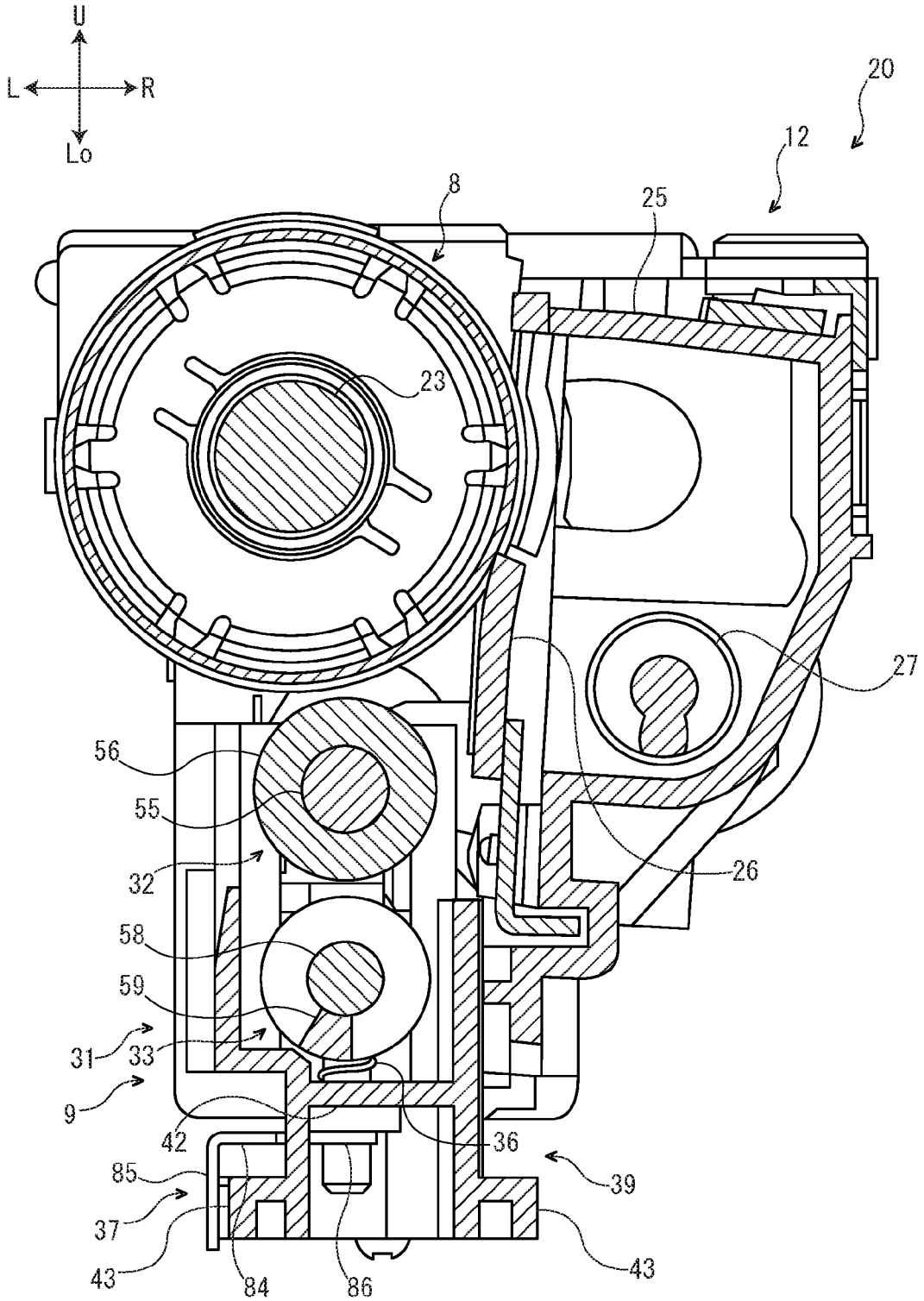
FIG. 4 is a sectional view showing a state that the charging roller separates from the photosensitive drum and the cleaning roller separates from the charging roller, in the drum unit according to the embodiment of the present disclosure.

As shown in FIGS. 3 and 4 and other figures, the cleaning device 12 includes a box-formed casing 25, a blade 26 which is attached to a lower left part of the casing 25 so as to come into contact with the photosensitive drum 8, and a screw 27 which is rotatably accommodated in a lower part of the casing 25. The toner removed from the photosensitive drum 8 by the blade 26 is conveyed by the screw 27, and is discharged to an outside of the casing 25 through a toner discharging port (not shown).

Next, the charging device 9 of the drum unit 20 will be described.

Figure 5:
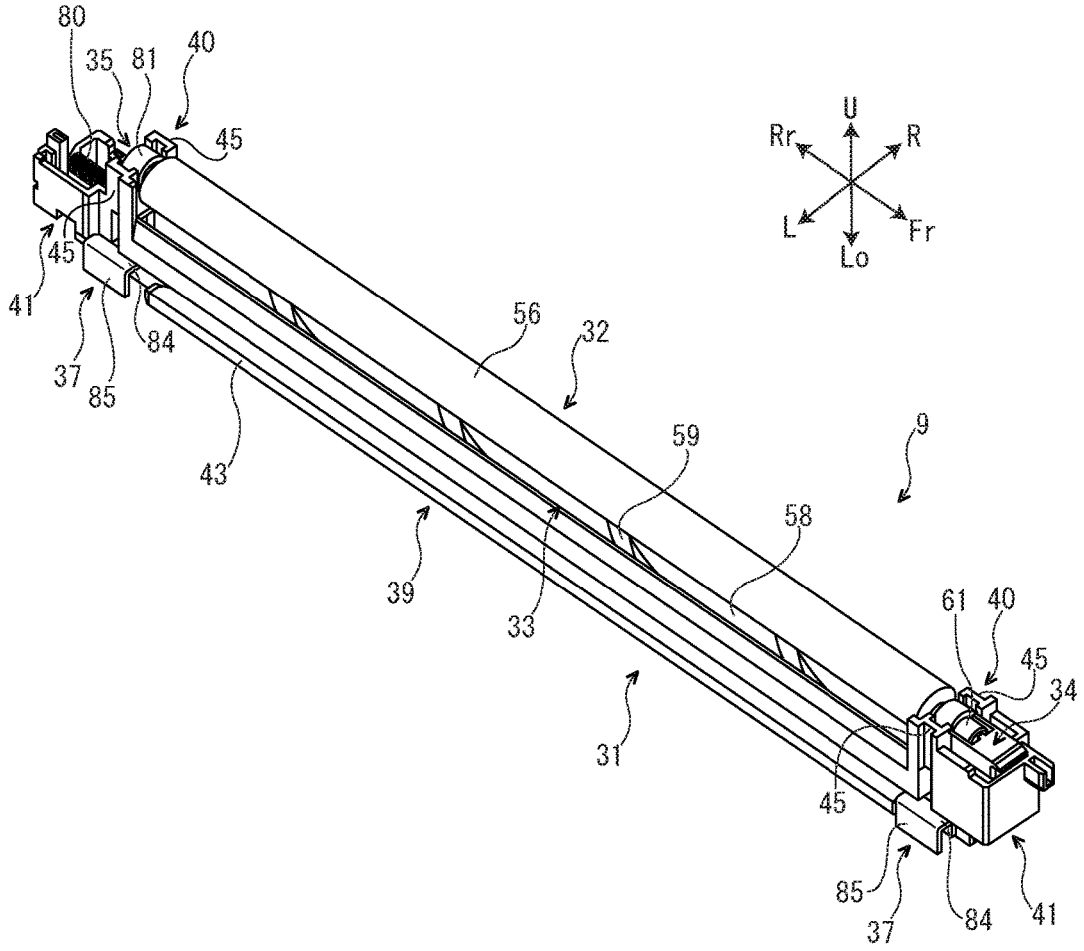
FIG. 5 is a perspective view seen from a left upper side and showing a charging device according to the embodiment of the present disclosure.
Figure 6:
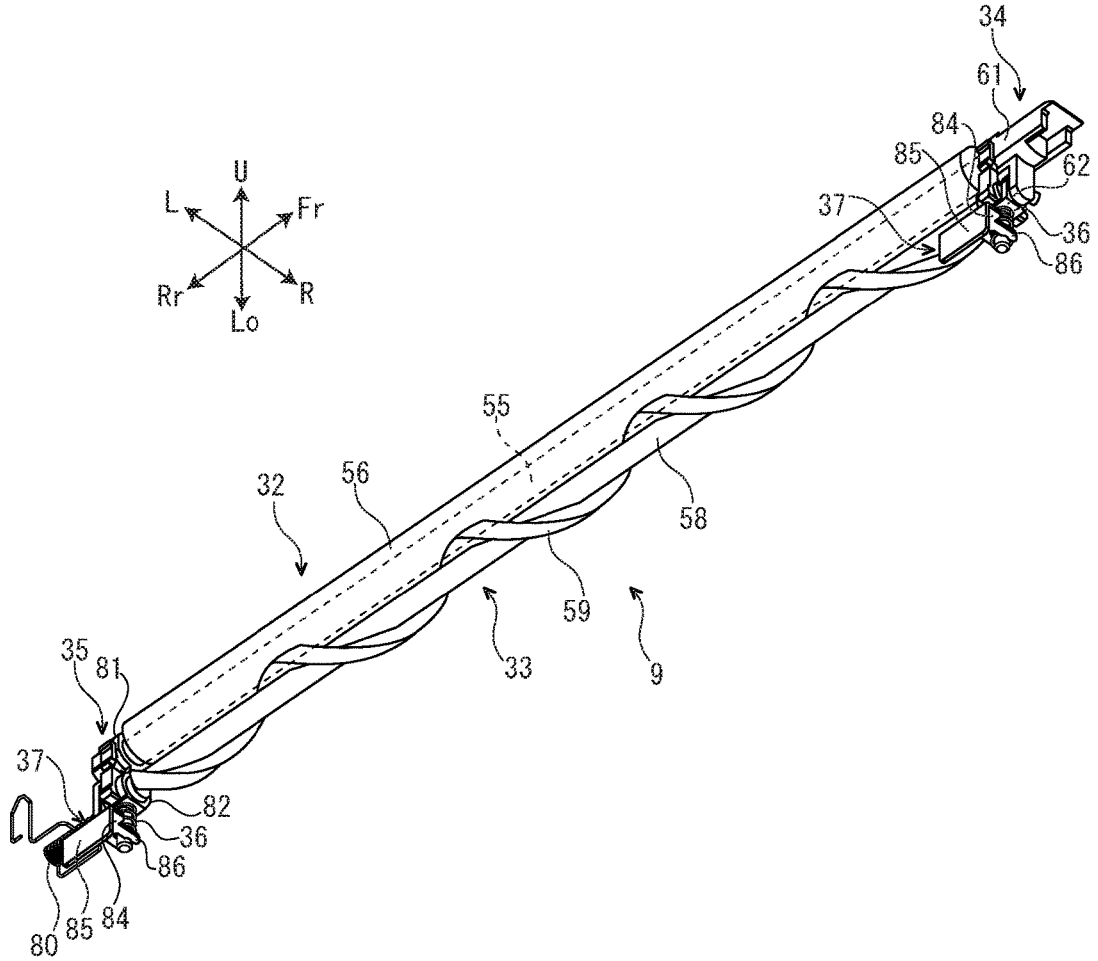
FIG. 6 is a perspective view seen from a left lower side and showing the charging device according to the embodiment of the present disclosure.

The charging device 9 is integrated as a charging unit. As shown in FIGS. 5 and 6 and other figures, the charging device 9 includes a frame 31 (not shown in FIG. 6), a charging roller 32 (a charging member) held at an upper part of the frame 31, a cleaning roller 33 (a cleaning member) held at a substantially center part of the frame 31, a front side bearing 34 held at a front part of the frame 31, a rear side bearing 35 held at a rear part of the frame 31, coil springs 36 (biasing members) arranged at a lower side of each bearing 34, 35, and stoppers 37 arranged at a left lower side of each bearing 34, 35.

As shown in FIG. 5 and other figures, the frame 31 includes a main body part 39, a pair of guide parts 40 arranged at both front and rear outsides of the main body part 39, and a pair of case parts 41 arranged at both front and rear outsides of a pair of the guide parts 40.

As shown in FIGS. 3 and 4 and other figures, the main body part 39 of the frame 31 is formed in a box shape whose upper face and lower face are opened. An internal space of the main body part 39 is vertically partitioned by a partitioning wall 42. Elongated protrusions 43 are protruded on lower end parts of both left and right side faces of the main body part 39. As shown in FIG. 5 and other figures, each elongated protrusion 43 extends along the front and rear direction.

Figure 7:
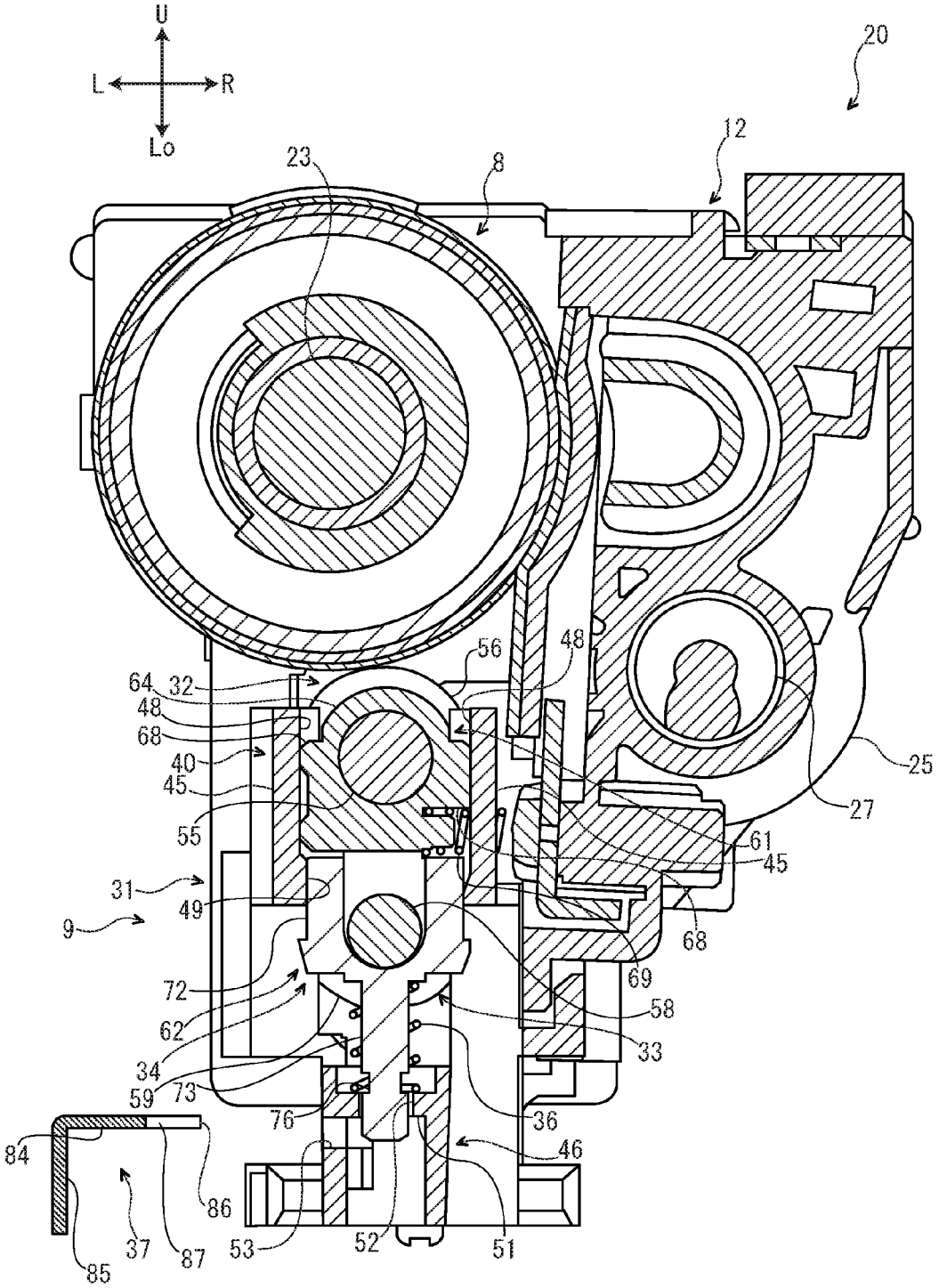
FIG. 7 is a sectional view showing a state that a first bearing part is held at a first contact position and a second bearing part is held at a second contact position, in the drum unit according to the embodiment of the present disclosure.
Figure 8:
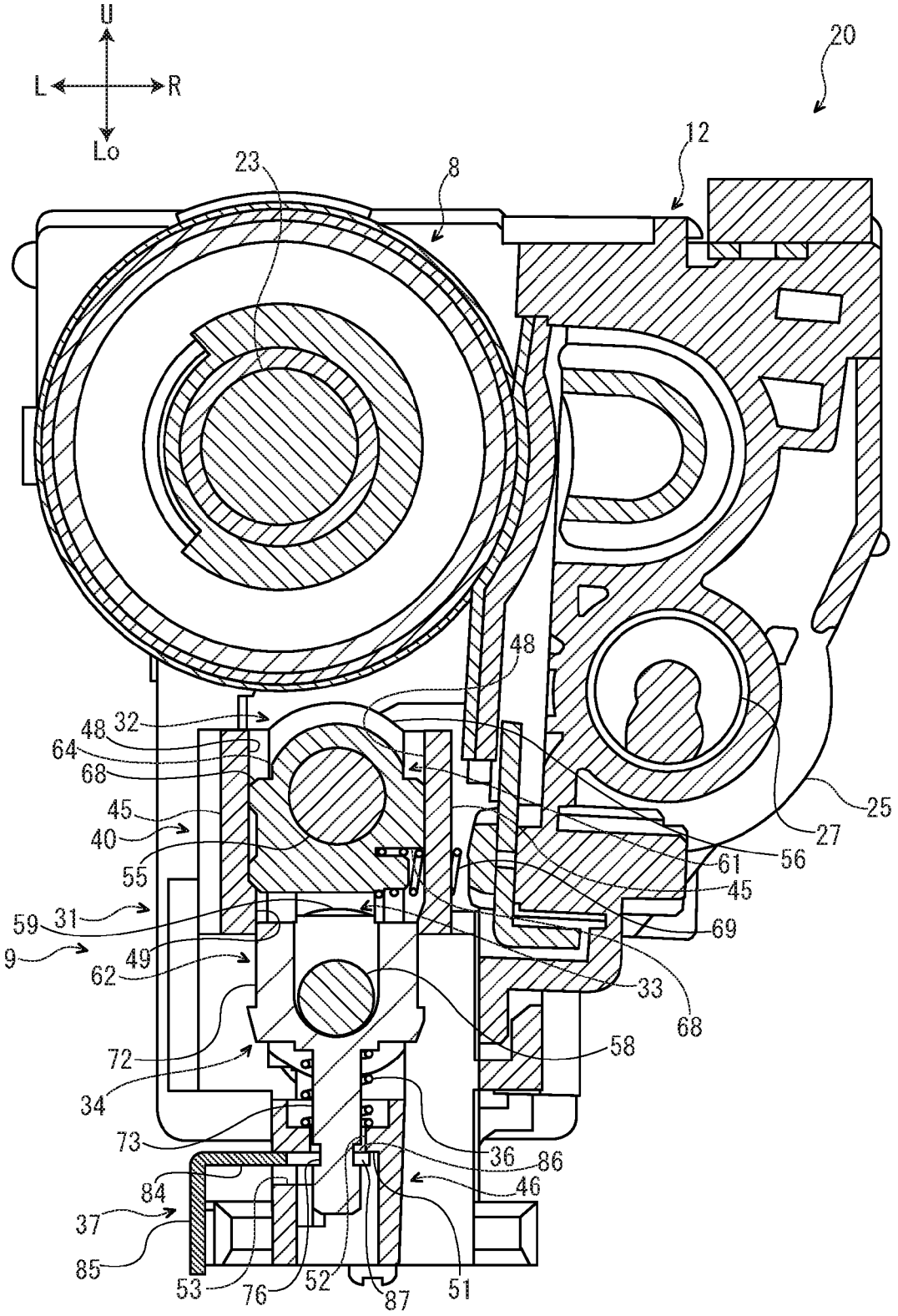
FIG. 8 is a sectional view showing a state that the first bearing part is held at a first separating position and the second bearing part is held at a second separating position, in the drum unit according to the embodiment of the present disclosure.

As shown in FIGS. 7 and 8 and other figures, each guide part 40 of the frame 31 includes a pair of left and right guide pieces 45 and a guide frame 46 arranged below a pair of the left and right guide pieces 45.

Figure 9:
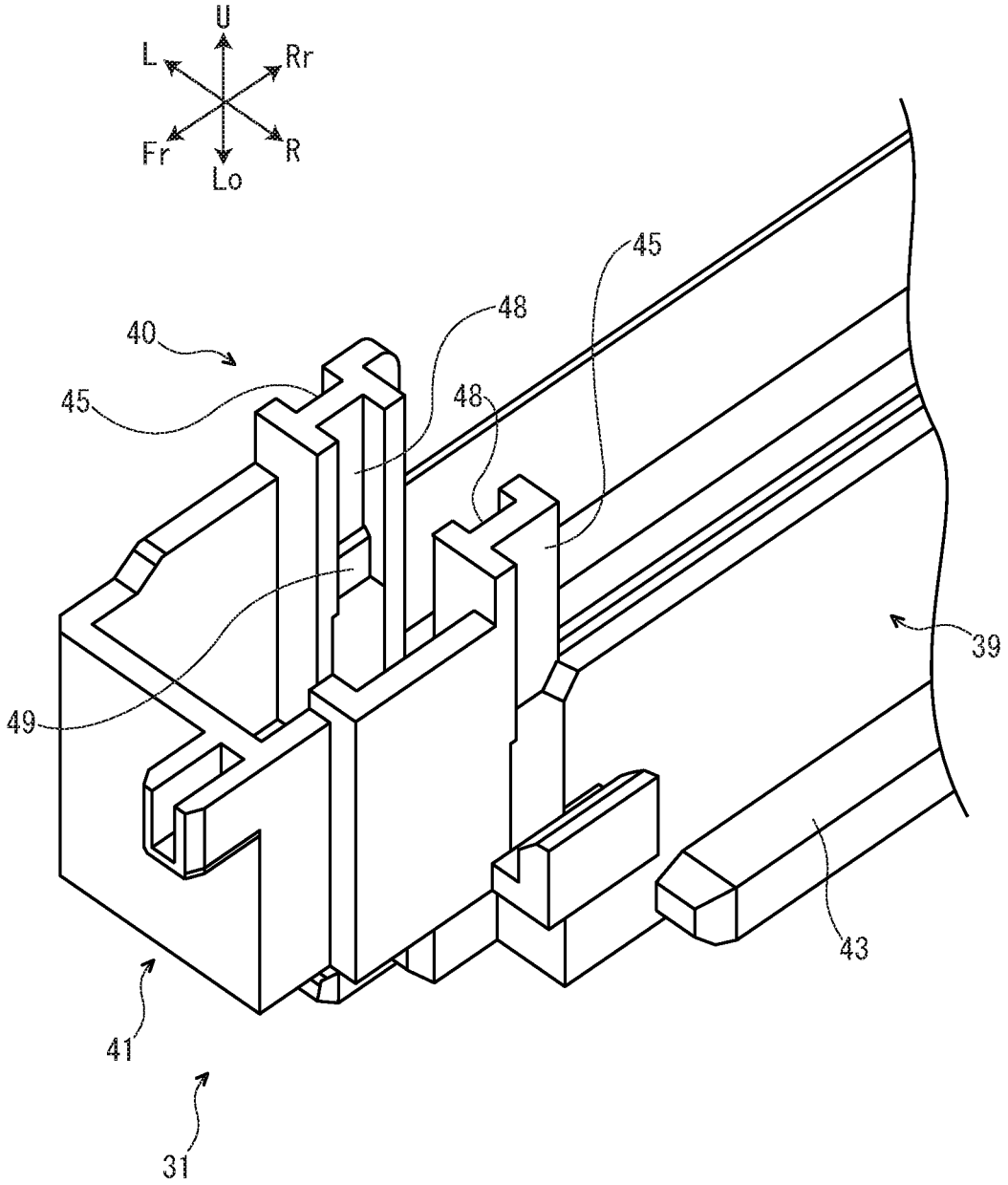
FIG. 9 is a perspective view showing a front part of a frame, in the charging device according to the embodiment of the present disclosure.

As shown in FIG. 9 and other figures, each guide piece 45 of each guide part 40 of the frame 31 extends along an upper and lower direction. An engagement slot 48 is formed on an inner face of each guide piece 45 along the upper and lower direction. A projecting part 49 is formed at a lower end part of the engagement slot 48 of the left guide piece 45.

As shown in FIGS. 7 and 8 and other figures, the guide frame 46 of each guide part 40 of the frame 31 extends along the upper and lower direction. An inside space of the guide frame 46 is partitioned into an upper part and a lower part by a partitioning plate 51. The partitioning plate 51 is provide with a through hole 52 formed along the upper and lower direction. A left sidepart of the guide frame 46 is provided with an insertion hole 53 formed along the left and right direction and arranged closer to the lower side than the partitioning plate 51.

As shown in FIG. 6 and other figures, the charging roller 32 extends along the front and rear direction. The charging roller 32 includes a charging axis 55 and a charging body 56 provided around the charging axis 55. The charging axis 55 is composed of a metal, for example. The charging body 56 is composed of a conductive rubber, for example.

The cleaning roller 33 extends along the front and rear direction. The cleaning roller 33 includes a cleaning axis 58 and a cleaning body 59 provided around the cleaning axis 58. The cleaning axis 58 is composed of a metal, for example. The cleaning body 59 is composed of a spiral sponge, for example.

Figure 10:
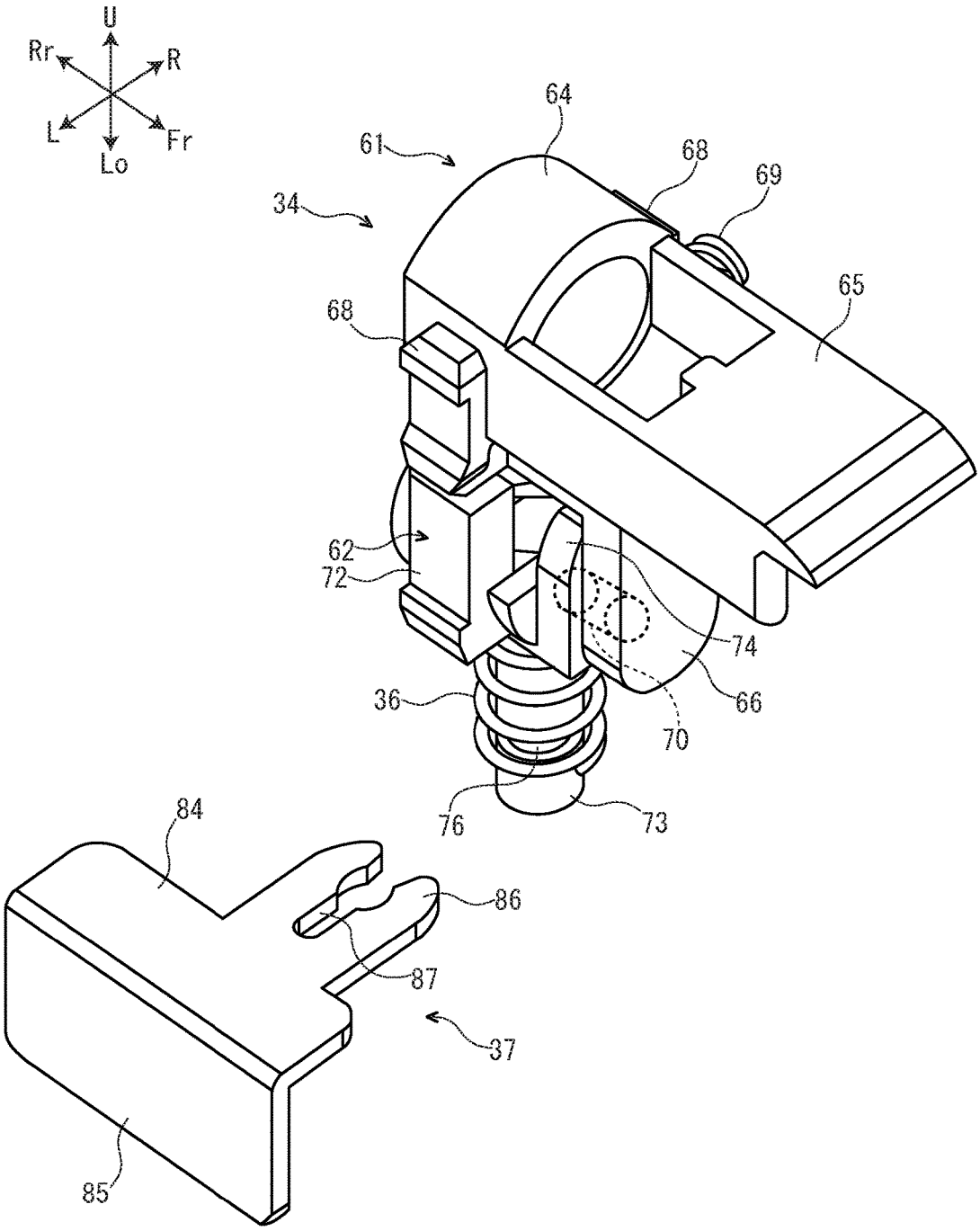
FIG. 10 is a perspective view showing a front side bearing, a coil spring, and a stopper, in the charging device according to the embodiment of the present disclosure.

As shown in FIG. 10 and other figures, the front side bearing 34 includes a first bearing part 61, and a second bearing part 62 arranged at a lower side of the first bearing part 61. In other words, the front side bearing 34 is divided into two of the first bearing part 61 and the second bearing part 62.

The first bearing part 61 of the front side bearing 34 includes a first attachment part 64, an extending part 65 extending forward from the first attachment part 64, and a first coupling part 66 protruding downward from the extending part 65.

As shown in FIGS. 7 and 8 and other figures, a front end part of the charging axis 55 of the charging roller 32 is attached to the first attachment part 64 of the first bearing part 61 of the front side bearing 34. Thus, the first bearing part 61 rotatably supports the front end part of the charging roller 32. Engagement protrusions 68 are arranged at both left and right side faces of the first attachment part 64. Each engagement protrusion 68 engages with the engagement slot 48 formed on each guide piece 45 of the front guide part 40 of the frame 31 in a movable state along the upper and lower direction. Thus, the first bearing part 61 is supported by the front guide part 40 of the frame 31 in a movable state along the upper and lower direction between a first contact position (see FIG. 7 and other figures) to make the charging body 56 of the charging roller 32 come into contact with the photosensitive drum 8 and a first separating position (see FIG. 8 and other figures) to make the charging body 56 of the charging roller 32 separate from the photosensitive drum 8. The first attachment part 64 is pressed to the left guide piece 45 by a pressing spring 69.

As shown in FIG. 10 and other figures, the first coupling part 66 of the first bearing part 61 of the front side bearing 34 extends along the upper and lower direction. A columnar coupling protrusion 70 is arranged on an inner face of the first coupling part 66.

The second bearing part 62 of the front side bearing 34 is divided from the first bearing part 61 of the front side bearing 34. In other words, the second bearing part 62 is separately provided from the first bearing part 61.

The second bearing part 62 of the front side bearing 34 includes a second attachment part 72, an axis part 73 protruded from the second attachment part 72 to the lower side (a side remote from the first bearing part 61), and a second coupling part 74 arranged at a front side of the second attachment part 72.

As shown in FIGS. 7 and 8 and other figures, a front end part of the cleaning axis 58 of the cleaning roller 33 is attached to the second attachment part 72 of the second bearing part 62 of the front side bearing 34. Thus, the second bearing part 62 rotatably supports a front end part of the cleaning roller 33. The second attachment part 72 engages with the engagement slot 48 formed on each guide piece 45 of the front guide part 40 of the frame 31 in a movable state along the upper and lower direction. Thus, the second bearing part 62 is supported by the front guide part 40 of the frame 31 in a movable state along the upper and lower direction between a second contact position (see FIG. 7 and other figures) to make the cleaning body 59 of the cleaning roller 33 come into contact with the charging body 56 of the charging roller 32 and a second separating position (see FIG. 8 and other figures) to make the cleaning body 59 of the cleaning roller 33 separate from the charging body 56 of the charging roller 32.

As shown in FIGS. 7 and 8 and other figures, the axis part 73 of the second bearing part 62 of the front side bearing 34 extends along the upper and lower direction. The axis part 73 penetrates the through hole 52 of the partitioning plate 51 arranged at the guide frame 46 of the front guide part 40 of the frame 31. A lower part of the axis part 73 is provided with a recess part 76.

Figure 11:
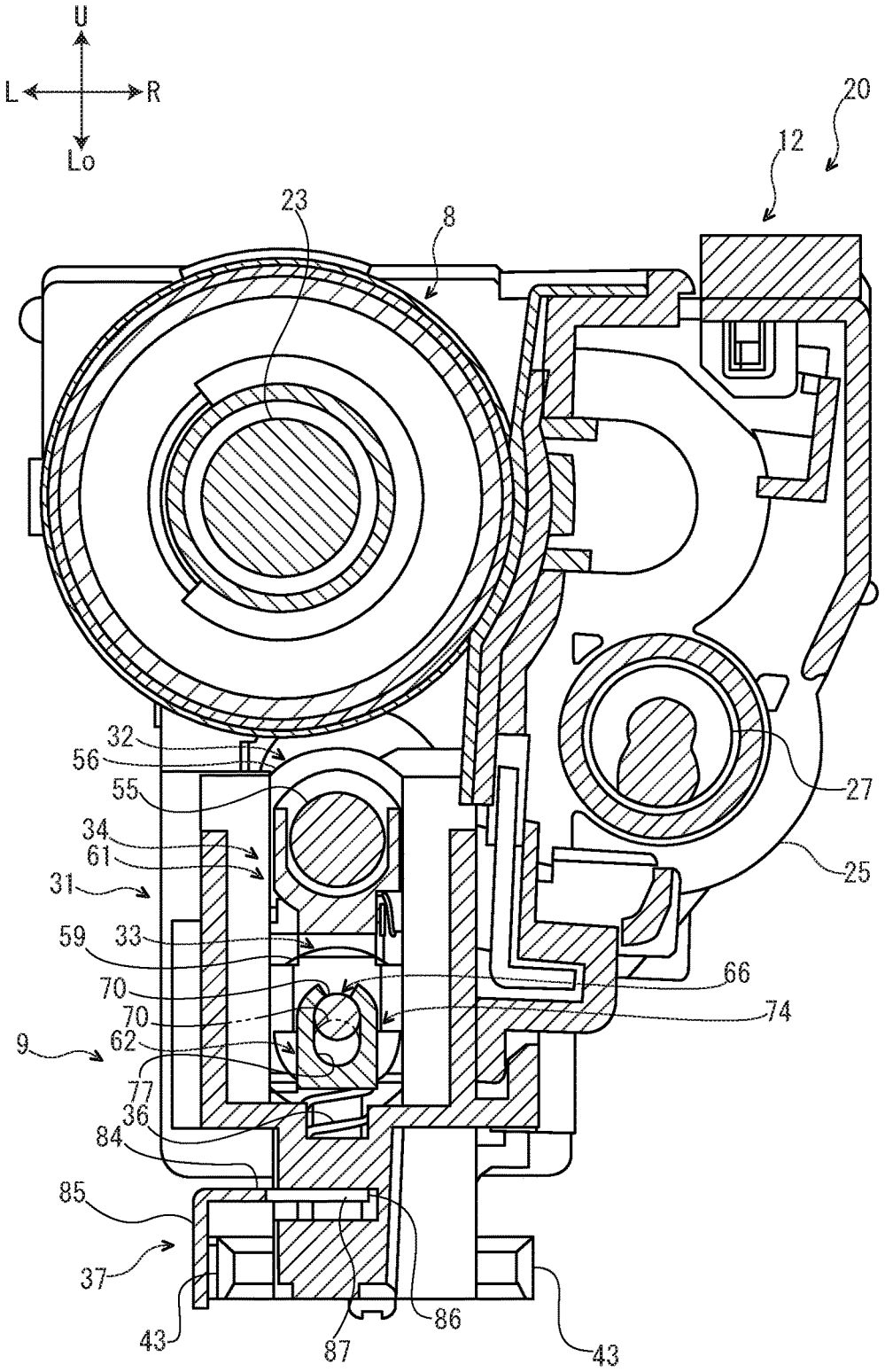
FIG. 11 is a sectional view showing a coupling part of the first bearing part and the second bearing part, in the drum unit according to the embodiment of the present disclosure.

As shown in FIG. 11 and other figures, the second coupling part 74 of the second bearing part 62 of the front side bearing 34 is provided with an elongated coupling hole 77 elongated along the upper and lower direction. With the coupling hole 77, the coupling protrusion 70 arranged at the first coupling part 66 of the first bearing part 61 of the front side bearing 34 engages in a movable state along the upper and lower direction. Thus, the second bearing part 62 is coupled with the first bearing part 61 in a state that the second bearing part 62 is movable along the upper and lower direction with respect to the first bearing part 61.

Figure 12:
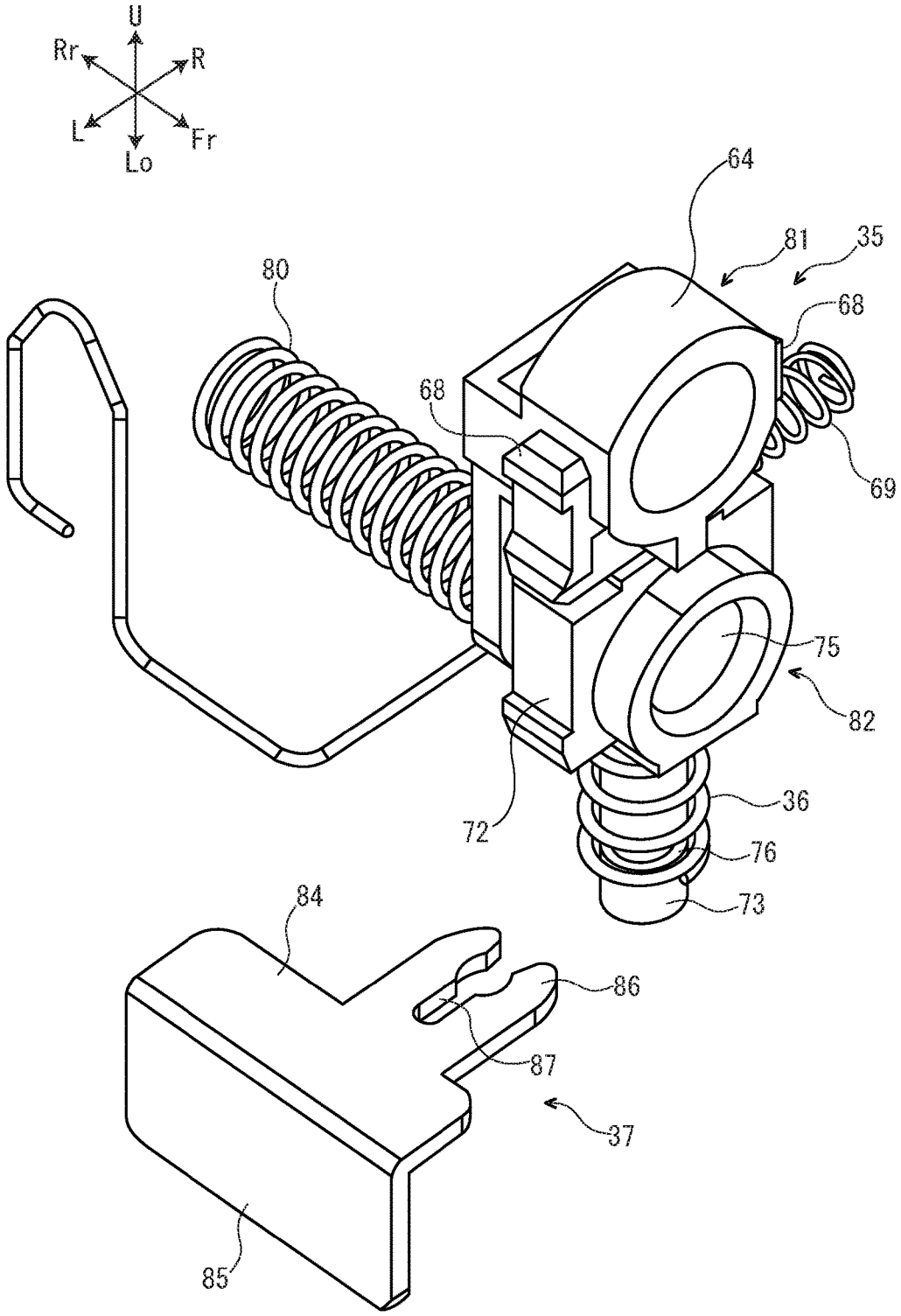
FIG. 12 is a perspective view showing a rear side bearing, a coil spring, a stopper, and a contact spring, in the charging device according to the embodiment of the present disclosure.

As shown in FIG. 12 and other figures, the rear side bearing 35 is connected with a contact spring 80. The contact spring 80 is connected with a charging bias applying part (not shown), and the charging bias applying part is configured to apply a charging bias to the charging roller 32 via the contact spring 80 and the rear side bearing 35.

The rear side bearing 35 includes a first bearing part 81 and a second bearing part 82 arranged at a lower side of the first bearing part 81. In other words, the rear side bearing 35 is divided into two of the first bearing part 81 and the second bearing part 82.

The first bearing part 81 of the rear side bearing 35 rotatably supports a rear end part of the charging roller 32. A configuration of the first bearing part 81 is substantially the same as the configuration of the first bearing part 61 of the front side bearing 34, and therefore will not be described. Incidentally, in FIG. 12, the same reference numerals as those of each part of the first bearing part 61 of the front side bearing 34 are assigned to each part of the first bearing part 81.

The second bearing part 82 of the rear side bearing 35 is divided from the first bearing part 81 of the rear side bearing 35. In other words, the second bearing part 82 is provided separately from the first bearing part 81. The second bearing part 82 rotatably supports a rear end part of the cleaning roller 33. A configuration of the second bearing part 82 is substantially the same as the configuration of the second bearing part 62 of the front side bearing 34, and therefore will not be described. Incidentally, in FIG. 12, the same reference numerals as those of each part of the second bearing part 62 of the front side bearing 34 are assigned to each part of the second bearing part 82.

As shown in FIGS. 7 and 8 and other figures, each coil spring 36 is attached to an outer circumference of the axis part 73 of the second bearing part 62 of each bearing 34, 35 (only the front side bearing 34 is shown in FIGS. 7 and 8). Each coil spring 36 is interposed between the partitioning plate 51 arranged at the guide frame 46 of each guide part 40 of the frame 31 and the second attachment part 72 of the second bearing part 62. Each coil spring 36 presses the second bearing part 62 toward the upper side and biases the second bearing part 62 to the second contact position (see FIG. 7 and other figures).

As shown in FIGS. 10 and 12 and other figures, each stopper 37 includes a top plate 84, a sideplate 85 bent downward from a left end part (a first end part) of the top plate 84, and an engagement plate 86 which extends from a right end part (a second end part) of the top plate 84 toward a right side (a side remote from the left end part of the top plate 84). The engagement plate 86 is divided into a front part and a rear part by a dividing slot 87.

Next, an operation of charging the photosensitive drum 8 by the charging device 9 in the drum unit 20 configured as mentioned above will be described.

When the charging device 9 charges the photosensitive drum 8, as shown in FIG. 3, the charging body 56 of the charging roller 32 (simply referred to as the "charging roller 32" below) is made to come into contact with the photosensitive drum 8, and the cleaning body 59 of the cleaning roller 33 (simply referred to as the "cleaning roller 33" below) is made to come into contact with the charging roller 32. Further, the charging bias applying part (not shown) applies the charging bias to the charging roller 32.

In this state, the driving source (not shown) rotates the photosensitive drum 8 (see an arrow A in FIG. 3). According to this, the charging roller 32 rotates with the photosensitive drum 8, and uniformly charges the photosensitive drum 8. Further, the cleaning roller 33 rotates with the charging roller 32 and cleans the charging roller 32.

Next, an operation of making the charging roller 32 come into contact with and separate from the photosensitive drum 8 and an operation of making the cleaning roller 33 come into contact with and separate from the charging roller 32 in the drum unit 20 configured as mentioned above will be described. Incidentally, operations of the first bearing part 81 and the second bearing part 82 of the rear side bearing 35 are the same as the operations of the first bearing part 61 and the second bearing part 62 of the front side bearing 34, and therefore will not be described.

When, for example, the operation of the drum unit 20 is inspected before the drum unit 20 is packaged, as shown in FIG. 7 and other figures, the second bearing part 62 is held in the second contact position by biasing force of the coil spring 36, and the second bearing part 62 presses the first bearing part 61 upward, so that the first bearing part 61 is held in the first contact position. Hence, as shown in FIG. 3 and other figures, the charging roller 32 comes into contact with the photosensitive drum 8, and the cleaning roller 33 comes into contact with the charging roller 32. Further, as indicated by a two-dot chain line in FIG. 11, the coupling protrusion 70 arranged at the first coupling part 66 of the first bearing part 61 engages with a lower end part of the coupling hole 77 arranged at the second coupling part 74 of the second bearing part 62.

Meanwhile, when, for example, the inspection of the operation of the drum unit 20 is finished and the drum unit 20 is packaged, as shown in FIG. 8 and other figures, the second bearing part 62 is lowered from the second contact position to the second separating position against the biasing force of the coil spring 36, and the engagement plate 86 of the stopper 37, which has been inserted into the guide frame 46 via the insertion hole 53, engages with the recess part 76 arranged at the axis part 73 of the second bearing part 62. According to this, as shown in FIG. 4 and other figures, the cleaning roller 33 separates from the charging roller 32.

Further, when the second bearing part 62 lowers from the second contact position to the second separating position as mentioned above, the press of the second bearing part 62 against the first bearing part 61 is released. Hence, as shown in FIG. 8 and other figures, the first bearing part 61 lowers from the first contact position to the first separating position by the own weight of the first bearing part 61, and the engagement protrusion 68 arranged at the first attachment part 64 of the first bearing part 61 comes into contact with the projecting part 49 arranged at the left guide piece 45 of each guide part 40 of the frame 31, so that the first bearing part 61 stops lowering. According to this, as shown in FIG. 4 and other figures, the charging roller 32 separates from the photosensitive drum 8.

Further, when the second bearing part 62 lowers from the second contact position to the second separating position and the first bearing part 61 lowers from the first contact position to the first separating position as mentioned above, as indicated by a solid line in FIG. 11, the coupling protrusion 70 arranged at the first coupling part 66 of the first bearing part 61 engages with an upper end part of the coupling hole 77 arranged at the second coupling part 74 of the second bearing part 62.

Incidentally, in the present embodiment, a movement distance of the second bearing part 62 when the second bearing part 62 lowers from the second contact position to the second separating position is 3.0 mm, and a movement distance when the first bearing part 61 lowers from the first contact position to the first separating position is 1.5 mm. That is, the movement distance of the first bearing part 61 is shorter than the movement distance of the second bearing part 62.

Meanwhile, when the drum unit 20 is taken out from the package and is actually used, as shown in FIG. 7 and other figures, by pulling the stopper 37 toward the left side, the engagement of the engagement plate 86 of the stopper 37 with the recess part 76 arranged at the axis part 73 of the second bearing part 62 is released. Thus, the second bearing part 62 rises from the second separating position to the second contact position by the biasing force of the coil spring 36. According to this, as shown in FIG. 3 and other figures, the cleaning roller 33 comes into contact with the charging roller 32.

Further, when the second bearing part 62 rises from the second separating position to the second contact position as mentioned above, the second bearing part 62 presses the first bearing part 61 upward. Hence, as shown in FIG. 7 and other figures, the first bearing part 61 rises from the first separating position to the first contact position. According to this, as shown in FIG. 3 and other figures, the charging roller 32 comes into contact with the photosensitive drum 8.

In the present embodiment, as mentioned above, at a stage before the drum unit 20 is actually used, the first bearing part 61 is held in the first separating position and the second bearing part 62 is held in the second separating position, so that it is possible to make the charging roller 32 separate from the photosensitive drum 8 and make the cleaning roller 33 separate from the charging roller 32. Consequently, it is possible to suppress deformation over time of the photosensitive drum 8, the charging roller 32 and the cleaning roller 33, to improve charging performance of image carriers, and to prevent defective images.

Further, when the second bearing part 62 rises from the second separating position to the second contact position, the second bearing part 62 presses the first bearing part 61 upward, and the first bearing part 61 rises from the first separating position to the first contact position. By applying such a configuration, it is possible to simultaneously perform the operation of making the cleaning roller 33 come into contact with the charging roller 32 and the operation of making the charging roller 32 come into contact with the photosensitive drum 8. Consequently, it is possible to reduce a burden on an operator compared to a case where these operations are separately performed.

Further, when the engagement of the stopper 37 with the second bearing part 62 is released, the second bearing part 62 rises from the second separating position to the second contact position by the biasing force of the coil spring 36. By applying such a configuration, it is possible to make the cleaning roller 33 come into contact with the charging roller 32 and to make the charging roller 32 come into contact with the photosensitive drum 8, by only releasing the engagement of the stopper 37 with the second bearing part 62. Consequently, it is possible to further reduce the burden on the operator.

Further, the stopper 37 engages with the recess part 76 arranged at the axis part 73 of the second bearing part 62. By applying such a configuration, it is possible to prevent the engagement of the stopper 37 with the second bearing part 62 from being unintentionally released.

Further, when the second bearing part 62 is at the second separating position, the engagement protrusion 68 of the first bearing part 61 comes into contact with the projecting part 49 arranged at each guide part 40 of the frame 31. By applying such a configuration, it is possible to reliably separate the cleaning roller 33 and the charging roller 32 when the second bearing part 62 is in the second separating position.

Further, the second bearing part 62 is coupled with the first bearing part 61 in a state that the second bearing part 62 is movable along the upper and lower direction with respect to the first bearing part 61. By applying such a configuration, even when the charging device 9 is turned over in a state that the first bearing part 61 is in the first separating position, it is possible to suppress movement of the first bearing part 61 from the first separating position to the first contact position and maintain a state that the charging roller 32 separates from the photosensitive drum 8.

In the present embodiment, as the engagement of the stopper 37 with the second bearing part 62 is released, the second bearing part 62 rises from the second separating position to the second contact position. In other embodiments, as the drum unit 20 is attached to the MFP main body 2, a part (for example, a guide rail configured to guide the drum unit 20) of the MFP main body 2 may press a part of each bearing 34, 35, so that the second bearing part 62 may rise from the second separating position to the second contact position.

In the present embodiment, the cleaning body 59 of the cleaning roller 33 is composed of a sponge. In other embodiments, the cleaning body 59 of the cleaning roller 33 may be composed of a brush or the like.

In the present embodiment, the configuration of the present disclosure is applied to the MFP 1. In other embodiments, the configuration of the present disclosure may be applied to an image forming apparatus other than the MFP 1, such as a printer, a copying machine, or a facsimile.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A charging device comprising:

a charging member configured to charge an image carrier;

a cleaning member configured to clean the charging member; and a bearing configured to rotatably support the charging member and the cleaning member, wherein the bearing includes:

a first bearing part configured to rotatably support the charging member; and a second bearing part configured to rotatably support the cleaning member and divided from the first bearing part, and the first bearing part is movable between a first contact position to make the charging member come into contact with the image carrier and a first separating position to make the charging member separate from the image carrier, and the second bearing part is movable between a second contact position to make the cleaning member come into contact with the charging member and a second separating position to make the cleaning member separate from the charging member, wherein, when the second bearing part is in the second separating position, the first bearing part is held in the first separating position, when the second bearing part is moved from the second separating position to the second contact position, the second bearing part presses the first bearing part and the first bearing part is moved from the first separating position to the first contact position, wherein the charging device further comprises:

a biasing member configured to bias the second bearing part to the second contact position; and a stopper configured to engage with the second bearing part so that the second bearing part is held in the second separating position against biasing force of the biasing member, and when engagement of the stopper with the second bearing part is released, the second bearing part is moved from the second separating position to the second contact position by the biasing force of the biasing member, wherein the stopper includes:

a top plate;

a side plate bent downward from a first end part of the top plate; and an engagement plate configured to extend from a second end part of the top plate toward a side remote from the first end part and to engage with the second bearing part, wherein the engagement plate is divided by a dividing slot.

2. The charging device according to claim 1, wherein the second bearing part includes:

an attachment part to which the cleaning member is attached; and an axis part protruded from the attachment part toward a side remote from the first bearing part, and the engagement plate is configured to engage with a recess part arranged on the axis part.

3. The charging device according to claim 1, further comprising a frame configured to hold the bearing, wherein the frame is provided with a guide part configured to support the first bearing part in a movable state between the first contact position and the first separating position, and when the second bearing part is in the second separating position, the first bearing part comes into contact with a projecting part arranged on the guide part.

4. The charging device according to claim 1, wherein the second bearing part is coupled with the first bearing part in a state that the second bearing part is movable with respect to the first bearing part.

5. The charging device according to claim 4, wherein the first bearing part is provided with a coupling protrusion, and the second bearing part is provided with an elongated coupling hole with which the coupling protrusion engages in a movable state.

6. An image forming apparatus comprising the charging device according to claim 1.

* * * * *